US005487339A

United States Patent [19]

Breventani et al.

[11] Patent Number: 5,487,339

[45] Date of Patent: Jan. 30, 1996

[54] METHOD FOR FASTENING A HOLDING BAR TO A PRINTING BLANKET

[75] Inventors: Walter Breventani, S. Giuliano Milanese; Natale Fossati, Cernusco sul Naviglio, both of Italy

[73] Assignee: Reeves Brothers, Inc., Spartanburg, S.C.

[21] Appl. No.: 190,822

[22] Filed: Feb. 2, 1994

[51] Int. Cl.[6] ..... B41F 1/28

[52] U.S. Cl. ..... 101/483; 101/415.1; 428/245

[58] Field of Search ..... 101/415.1, 401.1, 101/382.1, 483; 428/245

[56] References Cited

U.S. PATENT DOCUMENTS

| | | | |
|---|---|---|---|
| H440 | 3/1988 | O'Reil | 101/415.1 |
| 2,609,749 | 9/1952 | Kreglewski | 101/382.1 |
| 3,445,210 | 5/1969 | Matsuzaki et al. | 65/43 |
| 3,575,109 | 4/1971 | Wall | 101/401 |
| 3,844,214 | 10/1974 | Smith | 101/415.1 |
| 3,883,940 | 5/1975 | Wagner | 29/243.58 |
| 3,930,852 | 1/1976 | Tanaka et al. | 101/415.1 |
| 4,021,909 | 5/1977 | Bollmer | 29/432.1 |
| 4,092,923 | 6/1978 | Bollmer | 101/415.1 |
| 4,199,646 | 4/1980 | Hori et al. | 428/344 |
| 4,337,700 | 7/1982 | Etchell | 101/415.1 |
| 4,452,143 | 6/1984 | Heinemann et al. | 101/426 |
| 4,461,663 | 7/1984 | Tachibana et al. | 156/86 |
| 4,574,697 | 3/1986 | Feeley | 101/401 |
| 4,705,590 | 11/1987 | Vandenberg | 156/447 |
| 4,767,694 | 8/1988 | Schubert | 101/401.1 |
| 4,860,467 | 8/1989 | Larson | 38/102.4 |
| 4,925,506 | 5/1990 | Baker | 156/64 |
| 4,932,324 | 6/1990 | Pinkston et al. | 101/486 |
| 5,301,610 | 4/1994 | McConnell | 101/401.1 |
| 5,352,507 | 10/1994 | Bresson et al. | 428/24.5 |

FOREIGN PATENT DOCUMENTS

| | | | |
|---|---|---|---|
| 2809522 | 9/1979 | Germany | 101/415.1 |
| 3327972 | 2/1985 | Germany | 101/415.1 |
| 4319442 | 11/1992 | Japan | 101/415.1 |
| 8901866 | 3/1989 | WIPO | 101/415.1 |

*Primary Examiner*—Eugene H. Eickholt
*Attorney, Agent, or Firm*—Pennie & Edmonds

[57] ABSTRACT

A method for securing a mounting bar to a printing blanket by applying a strip of a hot melt adhesive tape along and adjacent an edge of the blanket, placing the mounting bar along the edge of the blanket upon the tape to form an assembly, and applying heat and pressure to the assembly for a sufficient time to melt the adhesive and securely attach the mounting bar to the blanket. The assembly may be cooled to more rapidly solidify the adhesive so that the assembly can be placed into service without waiting for a long adhesive curing time.

20 Claims, 2 Drawing Sheets

METHOD FOR FASTENING A HOLDING BAR TO A PRINTING BLANKET

TECHNICAL FIELD

This invention relates to an assembly for mounting and holding a printing blanket in a printing press cylinder. More specifically, this invention relates to a method for fastening the holding devices or bars used to hold such printing blankets on the printed cylindrical rollers.

BACKGROUND OF THE INVENTION

Sheet-fed printing presses are widely used in lithographic printing. In these presses, printing blankets are utilized to pick up the inked image from the printing plate and then transfer this image onto the paper which is to be printed. These printing blankets are comprised of an outer layer, formed mainly of a polymeric material, and a backing material on one side of the outer layer. The other side of the outer layer is the printing surface which carries ink for printing. The blanket is wrapped on a cylinder to transfer an inked image from a printing plate to paper during the printing process.

To achieve high quality printing, the blanket must not slip or creep on the cylinder. The conventional method of securing the blanket to the cylinder has been to secure the leading and trailing edges of the printing blanket between a channel formed into a holding bar. This holding bar is then housed in a gap or groove extending axially along the surface of the cylinder.

A number of considerations must be kept in mind when mounting these blankets to the holding bar, the foremost of which is to make sure that the printing blanket will not separate from the holding bar when the blanket is stretched taut over the printing cylinder. Another factor is the simplicity of installation and time involved in attaching the printing blankets. Conventional methods utilize a mono or bicomponent glue such as epoxy or polyurethane resin which is viscous and difficult to apply evenly. Furthermore, there is about a 24 hour delay between the application of the glue and bar to the blanket for curing prior to actual use.

Accordingly, there is a need for fastening a holding bar to a printing blanket in an expedient and inexpensive manner so that it will be able to bear the necessary mechanical stresses due to tensioning the blanket on the cylinder.

SUMMARY OF THE INVENTION

The present invention constitutes an improvement over the prior art as described above. In accordance with the present invention, a strip of an adhesive made of a thermoplastic or thermosetting hot melt material such as polyurethane or nylon is used to firmly bond the printing blanket to the holding bars.

This method according to the invention is well calculated to single-handedly perform the job of assembling a holding bar to a printing blanket. Thus, according to the invention, the adhesive strip is directly applied in the form of a strip upon the edge of the printing blanket. Thereafter, a holding bar is placed adjacent the adhesive strip, and sufficient heat and pressure are utilized to melt the adhesive. Upon heating, the adhesive forms a layer of substantially uniform thickness between the holding bar and the printing blanket; and adheres to both the bar and the blanket. The adhesive then establishes a firm bonding between these components on subsequent cooling.

The above and other features and advantages of this invention and the manner of attaining them will become more apparent, and the invention itself will best be understood, from a study of the following description with reference to the attached drawings.

DETAILED DESCRIPTION OF THE INVENTION

The term "hot melt" as used herein should be understood to mean any solid, thermoplastic or thermosetting adhesive which melts upon application of heat and then sets to a firm bond on cooling. Besides providing a sufficiently strong bond between the printing blanket and the holding bar, the adhesive layer therebetween can be remelted, if desired, after the use of the printing blanket, for example, to allow removal of the holding bar in reusable form.

Figure 1:
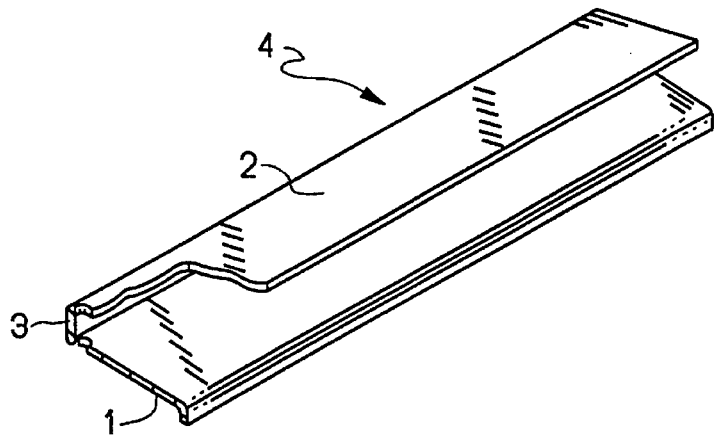
FIG. 1 is a fragmentary perspective view of a holding bar.

With reference to FIG. 1 of the drawing, a typical holding bar in accordance with the invention is shown. The holding bar is typically in the form of a channel-like member having a bight 3 and a pair of legs 1 and 2 diverging outwardly from opposite ends of the bight. The holding bar is adapted to be deformed so that the legs 1 and 2 are arranged substantially parallel as illustrated in FIG. 1.

Figure 2:
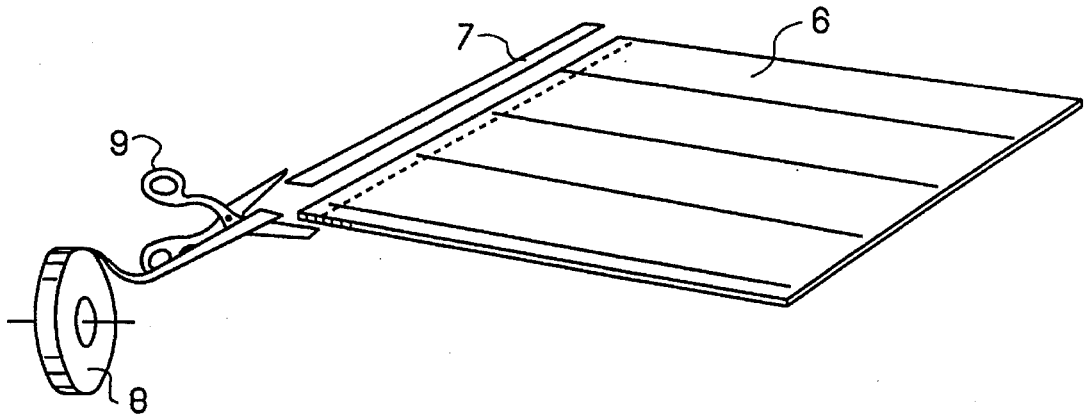
FIG. 2 is a perspective view of an unwrapped printing blanket and a layer of thermosetting adhesive.

For the preparation of the holding bar and printing blanket by the method of this invention, a strip of hot melt adhesive is applied to part of at least the top surface of the printing blanket 6. The adhesive 7 is preferably applied to the printing blanket 6 by unrolling a supply 8 and placing it along the edge of the bottom surface of the blanket 6. Thus, one embodiment of the invention includes a supply 8 and scissors apparatus 9 for cutting the strip for easy application to the printing blanket 6 as shown in FIG. 2.

Figure 3:
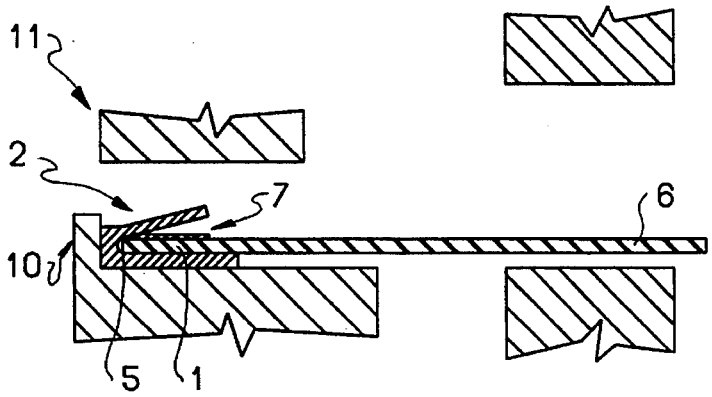
FIG. 3 is a side view of the printing blanket of FIG. 2 in between the legs of the holding bar of FIG. 1 and positioned in a heating station.

After the adhesive strip 7 has been applied on the printing blanket 6, the printing blanket 6 is placed in between legs 1 and 2 of holding bar 4. The legs of the holding bar 4 are moved apart in the area 5 where leg 1 adjoins bight 3 as shown in FIG. 3. This allows the edge of the printing blanket 6 to be positioned closely adjacent to bight 3 and preferably against the inside surface of such bight. The holding bar 4 can be slipped onto the printing blanket 6 immediately after, or concurrently with, the travel of the adhesive strip 7 rolled down the edge of the printing blanket 6.

Figure 4:
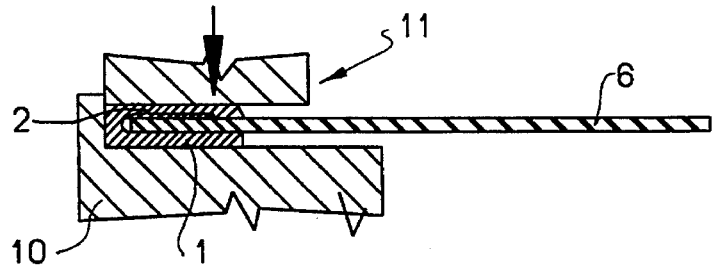
FIG. 4 is a side view of the printing blanket being fastened to the holding bar by the heating station.

The holding bar 4 and the printing blanket 6 are then fitted on the lower plane 10 of the heating station (limit switch) and the top plane 11 of the heating station is fitted over the top end of the holding bar as shown in FIG. 3. This station applies both heat and pressure to the assembly pressure is applied by lowering the upper plane 11 until the necessary force is applied to close the holding bar 4 at the required thickness as shown in FIG. 4. The holding bar 4 is then maintained in this position as long as the heat coming from the upper plane 11 is transmitted to the holding bar 4. The heat is applied to melt the adhesive strip so that it can adhere to each component. Generally, a temperature of about 180° C. is sufficient to do this.

The preferred adhesive strips are those which are hot melt adhesives of a thermosetting or thermoplastic nature, such as nylons or polyurethanes. Other hot melt adhesives are known to those skilled in the art and can also be used. At room temperature, these adhesives are solid and can be formed into desired shapes. For this invention, it is preferably to utilize flat strips of adhesive which have a uniform thickness and a width which corresponds to width of the legs of the holding bar. This enables a substantially uniform thickness of adhesive to be applied in the appropriate locations in a simple and straightforward manner, thus highly simplifying the manufacturing process compared to the use of liquid or semi-solid adhesives.

Moreover, the application of a substantially uniform thickness of the adhesive enables increased bond strengths to be obtained between the holding bar 4 and the blanket 6. Since the adhesive is a solid at room temperature, it is easy to handle and accurately place on the blanket. It also facilitates placement in the holding bar without initially sticking to the legs of the bar or otherwise being displaced inadvertently. The closing of the legs of the holding bar onto the adhesive strip and blanket also retain the position of the adhesive without squeezing or extruding it into undesired locations. Thereafter, the heat which is applied causes the adhesive strip to melt and adhere to the bar and blanket at a substantially uniform thickness for maximum bond strength. Also, the connection can be made easily and quickly, so that the blanket can be used minutes after being made, rather than in 24 hours when liquid adhesives are used.

Figure 5:
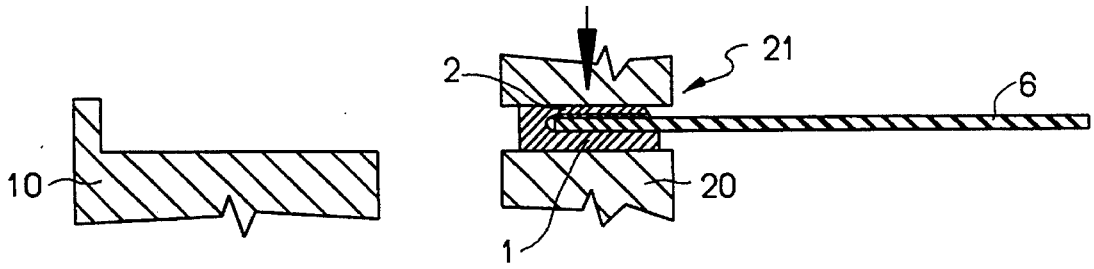
FIG. 5 is a side view of the bar and printing blanket assembly being cooled.

Finally, referring to FIG. 5, the upper plane 11 is lifted and the now barred blanket is taken off and forced to cool in a cooling station 20 and 21 which solidifies the adhesive 7 and provides a firm bond between the bar and the blanket. After cooling of holding bar 4 and printing blanket 6, the bar and the blanket are able to bear the necessary mechanical stresses due to tensioning in the cylinder, and can be immediately used.

The holding bar or similar bar may be made of any suitable material. Preferably the holding bar is made of an easily deformable, heat conductive, non-ferrous metallic material such as aluminum. Further, it will be appreciated that the holding bar may be of any suitable construction and reference is made to U.S. Pat. No. 3,883,940, for example, for a disclosure of holding bars of other materials and designs.

As has been mentioned in connection with the method of this invention, the printing blanket and/or the holding bar can be heated and provided with a hot melt adhesive in various ways other than those adopted in the embodiments of FIGS. 3–5. The applications and heating method of FIGS. 3–5 is preferred, however, because of the quickness of assembly, the ease with which the printing blanket is heated and coated, the constancy of the bar temperature, and the uniformity of the thickness of the resultant adhesive layer. Furthermore, the fitting of the holding bar over the printing blanket immediately after the application of the adhesive strip onto the latter, as in this embodiment, contributes to the uniformity of the thickness of the adhesive to thus provide a firmer union therebetween.

While present exemplary embodiments of this invention, and methods of practicing the same, have been illustrated and described, it will be recognized that this invention may be otherwise variously embodied and practiced within the spirit and scope of the following claims.

What is claimed:

1. A method for securing a mounting bar to a printing blanket which comprises:

applying a strip of hot melt adhesive along and adjacent an edge of the blanket;

placing the mounting bar along the edge of the blanket upon the strip to form an assembly;

applying heat and pressure to the assembly for a sufficient time to melt the adhesive and provide a substantially uniform thickness of such adhesive between the bar and blanket; and allowing the melted adhesive to solidify and securely attach the mounting bar to the blanket.

2. The method of claim 1 which further comprises selecting the hot melt adhesive strip to be in the form of a flat strip comprising a material selected from the group consisting of a thermosetting material and a thermoplastic material.

3. The method of claim 1 which further comprises selecting the hot melt adhesive strip to be in the form of a flat strip comprising a material selected from the group consisting of a polyurethane material and a nylon material.

4. The method of claim 1 wherein the blanket comprises a top printing surface and a bottom support surface, and which further comprises applying the adhesive strip to the bottom support surface of the blanket.

5. The method of claim 1 wherein the mounting bar comprises upper and lower spaced legs each having a surface for contacting the blanket edge and adhesive strip between the surfaces of upper and lower legs of the mounting bar before applying heat and pressure thereto.

6. The method of claim 5 wherein sufficient pressure is applied to the assembly to force the surfaces of the upper and lower legs to substantially completely contact the edge of the blanket.

7. The method of claim 6 wherein sufficient heat is applied to the bar to melt the adhesive strip so that the adhesive can melt and solidify to join the bar to the blanket.

8. The method of claim 7 which further comprises cooling the assembly to harden the adhesive and reduce the time within which the assembly can be mounted upon a printing cylinder.

9. The method of claim 4 which further comprises applying a second strip of hot melt adhesive strip to the top surface of the blanket along and adjacent the top edge thereof.

10. The method of claim 9 which further comprises selecting the second hot melt adhesive strip to be in the form of a flat strip comprising a material selected from the group consisting of a thermosetting material or a thermoplastic material.

11. The method of claim 9 which further comprises selecting the second hot melt adhesive strip to be in the form of a flat strip comprising a material selected from the group consisting of a polyurethane or nylon material.

12. The method of claim 1 wherein the bar is heated to about 180° C. to melt the adhesive strip.

13. The method of claim 9 wherein the bar is heated to about 180° C. to melt the adhesive strips.

14. The method of claim 1 which further comprises selecting the mounting bar to be of a heat conductive metal.

15. The method of claim 1 which further comprises selecting the mounting bar to be of aluminum.

16. A method for securing a mounting bar to a printing blanket having a first and second surfaces and an edge which comprises:

applying a first strip of hot melt adhesive strip along and adjacent an edge of the blanket on the first surface thereof;

providing a mounting bar of a heat conductive metal and having upper and lower spaced legs each having a surface for engaging the edge of the blanket;

inserting the blanket edge and adhesive strip between the surfaces of upper and lower legs of the mounting bar to form an assembly;

applying sufficient pressure upon the mounting bar to force the surfaces of the upper and lower legs toward each other to substantially completely contact the edge of the blanket;

applying heat to the mounting bar for a sufficient time to melt the adhesive and provide a substantially uniform thickness of such adhesive between the bar and blanket; and allowing the melted adhesive to solidify and securely attach the mounting bar to the blanket.

17. The method of claim 16 which further comprises applying a second strip, of hot melt adhesive strip to the second surface of the blanket.

18. The method of claim 17 which further comprises selecting at least one of the first or second hot melt adhesive strips to be a plastic material in the form of a flat strip.

19. The method of claim 18 wherein at least one of the first or second hot melt adhesive strips comprises a material selected from the group consisting of polyurethane and nylon.

20. The method of claim 16 wherein the bar is heated to about 180° C. to melt the adhesive strip.

* * * * *